US009725868B2

(12) United States Patent
Hall

(10) Patent No.: US 9,725,868 B2
(45) Date of Patent: Aug. 8, 2017

(54) OFFSHORE SUPPORT STRUCTURE

(71) Applicant: KEYSTONE ENGINEERING INC., Mandeville, LA (US)

(72) Inventor: Rudolph A. Hall, Mandeville, LA (US)

(73) Assignee: KEYSTONE ENGINEERING INC., Mandeville, LA (US)

( * ) Notice: Subject to any disclaimer, the term of this patent is extended or adjusted under 35 U.S.C. 154(b) by 0 days.

(21) Appl. No.: 14/720,520

(22) Filed: May 22, 2015

(65) Prior Publication Data

US 2015/0337517 A1 Nov. 26, 2015

Related U.S. Application Data

(60) Provisional application No. 62/002,678, filed on May 23, 2014.

(51) Int. Cl.
*E02D 27/42* (2006.01)
*E02D 27/20* (2006.01)
(Continued)

(52) U.S. Cl.
CPC ..... *E02D 27/20* (2013.01); *E02B 17/02* (2013.01); *E02D 5/22* (2013.01); *E02D 25/00* (2013.01); *E02D 27/18* (2013.01); *E02D 27/425* (2013.01); *E02D 27/50* (2013.01); *E02D 27/52* (2013.01); *E02B 2017/0056* (2013.01);
(Continued)

(58) Field of Classification Search
CPC ..... E02D 27/12; E02D 27/14; E02D 27/16; E02D 27/18; E02D 27/20; E02D 27/42; E02D 27/44; E02D 27/50; E02D 27/52; E02D 27/425
See application file for complete search history.

(56) References Cited

U.S. PATENT DOCUMENTS

| | | | |
|---|---|---|---|
| 4,966,496 | A | 10/1990 | Stelzer, Jr. |
| 2011/0135400 | A1 | 6/2011 | Hall |
| 2012/0263545 | A1 | 10/2012 | Oestergaard et al. |

FOREIGN PATENT DOCUMENTS

| | | | |
|---|---|---|---|
| CN | 202787299 | * | 3/2013 |
| DE | 102012111769 | * | 6/2014 |

(Continued)

OTHER PUBLICATIONS

International Search Report ; PCT/US2015/032284; issued on Aug. 18, 2015.

(Continued)

*Primary Examiner* — Sunil Singh
(74) *Attorney, Agent, or Firm* — Studebaker & Brackett PC

(57) ABSTRACT

A support structure for an offshore device is provided, including a vertical guide sleeve and three elongated guide sleeves positioned around the vertical guide sleeve, and various braces connecting the elongated sleeves and the vertical guide sleeve. The support structure also includes a transition joint including a cylindrical portion for connection to an offshore device, such as a support tower of a wind turbine assembly, and a conical portion connected to the vertical guide sleeve. To provide resistance to thrust, bending, and torsional fatigue, at least one set of braces is formed in an oval, racetrack, obround, or stadium configuration, and one or more horizontal stiffeners are positioned in the transition joint to maximize the strength of the support structure.

10 Claims, 7 Drawing Sheets

(51) Int. Cl.

| | |
|---|---|
| ***E02B 17/02*** | (2006.01) |
| ***E02D 5/22*** | (2006.01) |
| ***E02D 25/00*** | (2006.01) |
| ***E02D 27/18*** | (2006.01) |
| ***E02D 27/50*** | (2006.01) |
| ***E02D 27/52*** | (2006.01) |
| *E02B 17/00* | (2006.01) |
| *E02D 27/44* | (2006.01) |

(52) U.S. Cl.
CPC ..... *E02B 2017/0091* (2013.01); *E02D 27/42* (2013.01); *E02D 27/44* (2013.01)

(56) References Cited

FOREIGN PATENT DOCUMENTS

| | | | | |
|---|---|---|---|---|
| EP | 2067914 | A2 | | 6/2009 |
| EP | 2495370 | A1 | | 9/2012 |
| JP | 201376240 | | * | 4/2013 |
| WO | WO 2006053254 | | * | 5/2006 |
| WO | WO 2010121596 | | * | 10/2010 |

OTHER PUBLICATIONS

Written Opinion of the International Searching Authority; PCT/US2015/032284; issued on Aug. 18, 2015.
Notification of Concerning Transmittal of International Preliminary Report on Patentability (Chapter I) and Translation of Written Opinion of the International Searching Authority; PCT/US2015/032284; issued on Dec. 8, 2016.

* cited by examiner

OFFSHORE SUPPORT STRUCTURE

CROSS-REFERENCE TO RELATED APPLICATIONS

This application claims the benefit of priority to U.S. Provisional Patent Application No. 62/002,678, filed on May 23, 2014, which is hereby incorporated by reference in its entirety.

TECHNICAL FIELD

This disclosure generally relates to structures used to support offshore components. In particular, this disclosure relates to support structures such as, for example, offshore wind turbines, or the like.

BACKGROUND

Conventional offshore support structures have deck legs that are vertical or are battered outward as they extend downwards. Various conventional arrangements provide sufficient structural support for the deck and offshore device but the associated dimensions of structures result in high material and installation expense. Wind turbines have conventionally been supported on mono-piles when placed offshore. Recently, there has been a drive to position wind turbines further from shore (approximately six to seven or more miles offshore), and in deeper water, in part to increase the aesthetics of the view from the shoreline. To support wind turbines in relatively deep water, mono-piles become extremely long, heavy, and cumbersome, making mono-piles relatively expensive as a wind turbine support.

Jacket type foundations or support structures with driven pipe piles have been used to support offshore wind turbines in recent years as the offshore wind industry has considered deeper water sites not previously considered feasible for mono-pile or gravity type foundations based on the added cost. As turbines grew in size to generate more power, the complexity and weight of a joint or transition piece, located between lower supports and the wind turbine tower, increased. This joint is typically a cast, forged, or heavy wall steel welded connection manufactured during the onshore fabrication phase of construction. The fabrication and installation of heavy wall joints can be a significant cost component to the wind turbine foundation.

SUMMARY OF THE INVENTION

This disclosure provides a support structure for an offshore device. The support structure includes a vertical guide sleeve and three elongated guide sleeves positioned around the vertical guide sleeve, and various braces connecting the elongated sleeves and the vertical guide sleeve. The support structure also includes a conical transition joint including a cylindrical portion for connection to an offshore device, such as a support tower of a wind turbine assembly, and a conical portion connected to the vertical guide sleeve. To provide resistance to thrust, bending, and torsional fatigue, at least one set of braces is formed in an oval, racetrack, obround, or stadium configuration, and one or more horizontal stiffeners are positioned to provide a ring-stiffened chord in the transition joint to maximize the strength of the support structure.

DETAILED DESCRIPTION

A support structure in accordance with an exemplary embodiment of the present disclosure for supporting an offshore device, such as a wind turbine, including a transition joint having a conical portion, will be described in relation to an offshore wind turbine. Of course, the support structure may be used to support other offshore devices such as oil and/or gas drill platforms. To avoid unnecessarily obscuring the exemplary embodiments, the following description omits details of well-known structures and devices that may be shown in block diagram form or otherwise summarized. For the purpose of explanation, other details are set forth to provide a thorough understanding of the exemplary embodiments. It should be appreciated that the exemplary embodiments may be practiced in a variety of ways beyond these specified details. For example, the systems and methods of the exemplary embodiments can be generally expanded and applied to connections with larger or smaller diameter components and transition joints. Furthermore, while exemplary distances and scales may be shown in the figures, it is to be appreciated the system and methods in this disclosure can be varied to fit any particular implementation.

Figure 1:
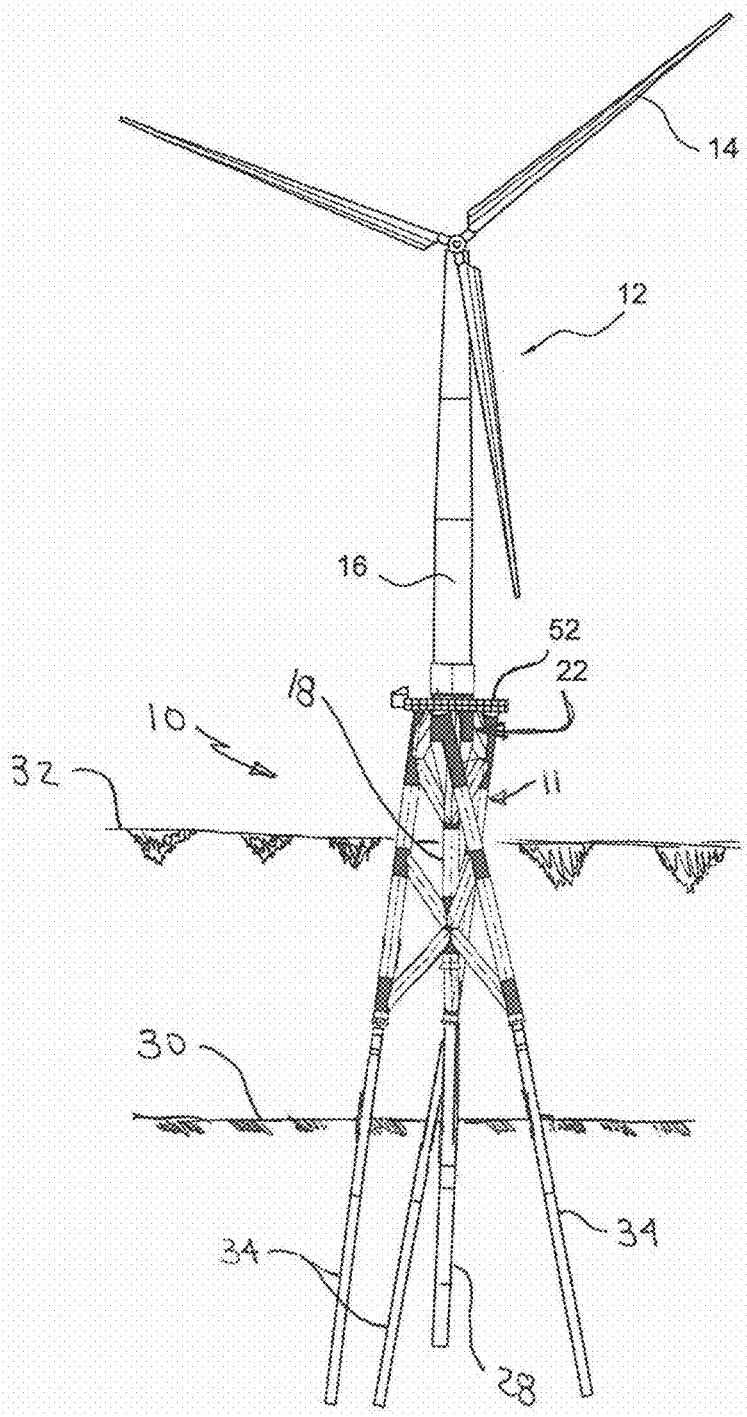
FIG. 1 is an elevation view of a support structure and wind turbine in accordance with an exemplary embodiment of the present disclosure.

Referring to FIG. 1, a support structure 10 in accordance with an exemplary embodiment of the present disclosure is shown in combination with a wind turbine assembly 12, which includes blades 14 and a support tower 16. Support structure 10 may be generally referred to as an inward battered or twisted jacket type. Support structure 10 may include features from support structures shown in U.S. Pat. Nos. 6,783,305, 7,134,809, 7,198,453, 7,942,611, 8,444,349, and 8,511,940, the entire contents of which are hereby incorporated by reference in their entirety. In the exemplary embodiment, and referring also to FIG. 2, support structure 10 includes a hollow vertical guide member or caisson sleeve 18 configured to include a vertical longitudinal axis 48, three hollow elongated guide elements or pile sleeves 20 positioned or arrayed around or about caisson sleeve 18, and various braces connecting pile sleeves 20 to caisson sleeve 18. Support structure 10 also includes a transition joint assembly 22 including a cylindrical portion 24 for connection to an offshore device, such as support tower 16 of wind turbine assembly 12, and a conical portion 26 connected to caisson sleeve 18. In an exemplary embodiment, cylindrical portion 24 is at least twice the diameter of caisson sleeve 18.

In another exemplary embodiment, cylindrical portion 24 is at least two and a half times the diameter of caisson sleeve 18.

The combination of caisson sleeve 18, pile sleeves 20, a plurality of braces, described hereinbelow, and transition joint assembly 22, form a sub-support or guide portion 11 of support structure 10. Guide portion 11 is mounted on a vertical caisson 28 driven into a support surface 30, i.e., the ocean floor or sea bed, and a plurality of pile sections 34 are then driven into support surface 30 positioned below a water line 32. Vertical caisson 28 is configured to slide into hollow caisson sleeve 18 and, and pile sections 34 are configured to slide through pile sleeves 20 to thereby support guide portion 11 above water line 32. Support structure 10 minimizes the costs and time associated with material, assembly (manufacture), and installation, while possessing sufficient strength, and effectively and efficiently handling and transferring loads from wind turbine 12 to support surface 30 throughout operation and while maintaining excellent fatigue resisting characteristics to withstand the extensive cyclic loading induced by wind and waves.

Figure 2:
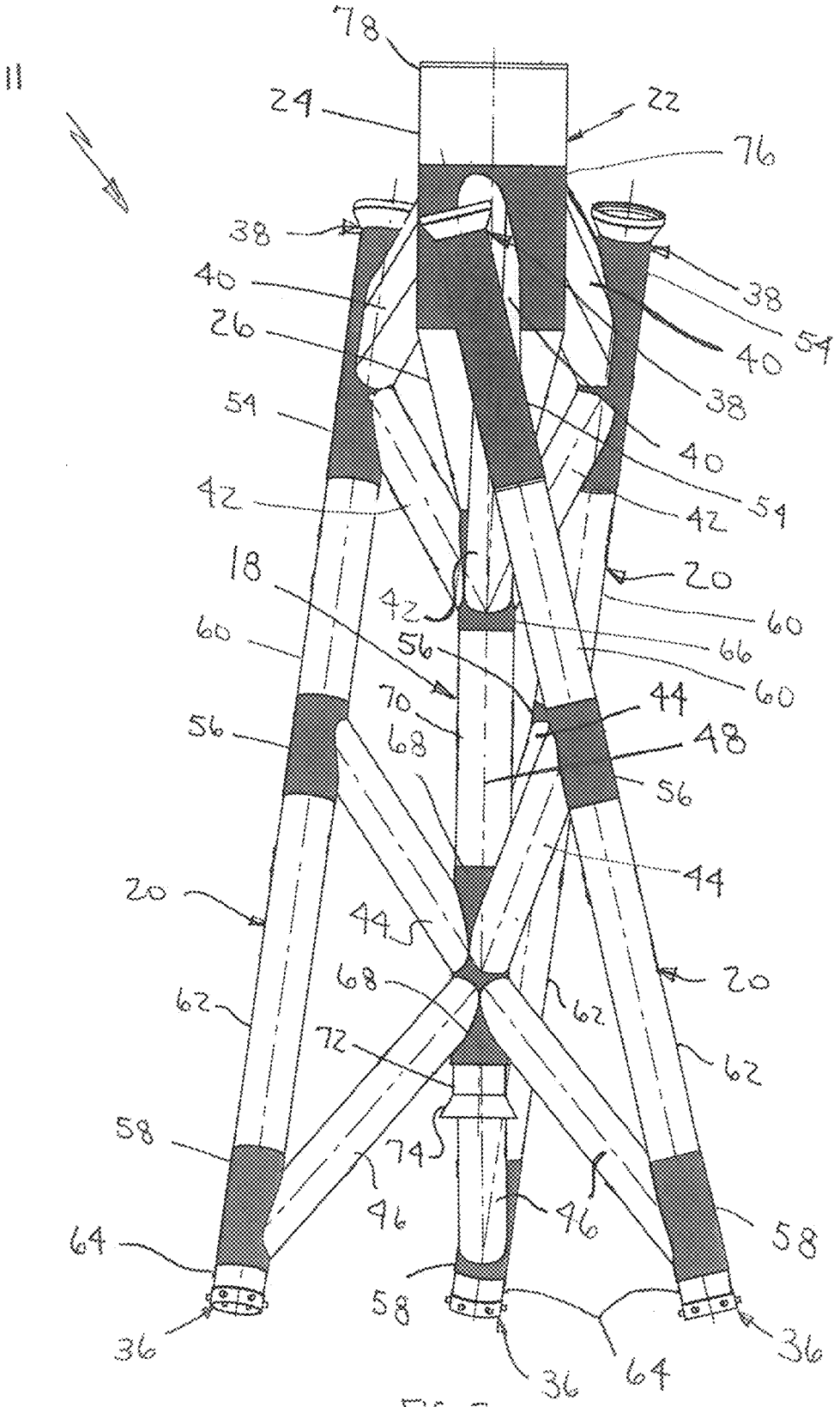
FIG. 2 is an elevation view of a sub-support or guide portion of the support structure of FIG. 1.

Each pile sleeve 20 includes a distal end or portion 36 and a proximal end or portion 38 positioned radially closer to caisson sleeve 18 than distal end 36. The three pile sleeves 20 are positioned approximately 120 degrees apart circumferentially around caisson sleeve 18, and thus their distal ends 36, and their proximate ends 38, are offset from each other by about 120 degrees in a circumferential direction. Each pile sleeve 20 extends from distal end 36 towards proximal portion 38 at an angle from longitudinal or vertical axis 48 to create a chiral or twisted shape. Each pile sleeves 20 also extends inwardly towards caisson sleeve 18 so that proximal portion 38 is positioned radially closer to caisson sleeve 18 than distal end 36, as shown in FIGS. 1 and 2. Each pile sleeve 20 is connected to transition joint assembly 22 at a first longitudinal position by at least one upper angled brace 40 connected, e.g., by welding, at a first end to a respective pile sleeve 20 and at a second end to cylindrical portion 24 of transition joint assembly 22. In the exemplary embodiment of FIG. 2, additional sets of angled braces are also used to connect caisson sleeve 18 and pile sleeves 20. Specifically, upper intermediate or middle diagonal or angled braces 42 are each connected at a first end to a respective pile sleeve 20, and extend downwardly and inwardly to connect to a proximal or first sleeve end of caisson sleeve 18 at a second end of angled brace 42, and which is a second longitudinal position along guide portion 11. In addition, a set of lower intermediate, middle diagonal, or angled braces 44 and a set of lower diagonal or angled braces 46 may be provided, wherein each lower middle angled brace 44 is connected to a longitudinally middle area of a respective pile sleeve 20 and extends downwardly and inwardly to connect to a lower or distal portion of caisson sleeve 18, and wherein each lower angled brace 46 is connected at a first end to a respective pile sleeve 20 adjacent distal end 36 and extends inwardly and upwardly to connect to caisson sleeve 18 at a second end. The connection of angled brace 46 to caisson sleeve 18 can be adjacent to the connection of lower middle angled brace 44 to caisson sleeve 18. Each of the connections described herein may be accomplished in an exemplary embodiment by, for example, welding, or may be connected by a flange and bolt arrangement (not shown), or other attachment arrangements.

Though not shown, additional braces may extend between pile sleeves 20 and caisson sleeve 18. For example, lateral braces (not shown) may extend substantially perpendicular to longitudinal axis 48 between pile sleeves 20 and caisson sleeve 18. However, the configuration shown in FIG. 2 provides for improved fatigue resistance and simplified construction in the absence of lateral braces, and thus provides benefits over configurations that may include such braces. Furthermore, in certain environments, such as shallow water, some braces, such as lower intermediate angled braces 44, may be unnecessary and therefore not installed. Referring to FIG. 1, a platform 52 may be connected at the proximal ends of pile sleeves 20, and other appurtenances such as ladders, stairs, conduits for electrical cables, etc. (not shown) may also be attached to and supported by support structure 10.

Each elongated pile sleeve 20 may be formed as a plurality of sections or portions. For example, each pile sleeve 20 may include a plurality of reinforced or heavy wall sections, with a plurality of sections positioned between or adjacent to the reinforced or heavy wall sections and directly connected to the heavy wall sections. In the exemplary embodiment of FIG. 2, each pile sleeve 20 may include an upper heavy wall portion 54, an intermediate or middle heavy wall portion 56, and a lower heavy wall portion 58. An upper pile sleeve 60 may be positioned between a respective upper heavy wall portion 54 and a respective middle heavy wall portion 56. A lower pile sleeve 62 may be positioned between a respective middle heavy wall portion 56 and a lower heavy wall portion 58. A lower pile sleeve extension 64 may be positioned on an opposite side of lower heavy wall portion 58 from lower pile sleeve 62. Each of the reinforced or heavy wall sections may be associated with one or more braces. Upper heavy wall portion 54 may be a point of attachment for upper angled brace 40 and upper middle angled brace 42. Middle heavy wall portion 56 may be a point of attachment for lower middle angled brace 44. Lower heavy wall portion 58 may be a point of attachment for lower angled brace 46.

Vertical guide member or caisson sleeve 18 may also be formed as a plurality of sections or portions. For example, caisson sleeve 18 may include an upper caisson heavy wall portion 66 and a lower caisson heavy wall portion 68. Upper caisson heavy wall portion 66 may be an attachment location for one or more upper middle or intermediate diagonal or angled braces 42. Lower caisson heavy wall portion 68 may be an attachment location for one or more lower middle or intermediate diagonal or angle braces 44 and lower diagonal or angled braces 46. An upper caisson sleeve 70 may be positioned between upper caisson heavy wall portion 66 and lower caisson heavy wall portion 68. A lower caisson sleeve extension 72 may be positioned at a distal end of caisson sleeve 18 on an opposite side of lower caisson heavy wall portion 68 from upper caisson sleeve 70. A caisson sleeve guide cone 74 may be provided at a distal end of lower caisson sleeve extension 72 for assisting the engagement of vertical caisson 28 with caisson sleeve 18 when positioning or locating guide portion 11 on vertical caisson 28 during on-site installation of guide portion 11. A distal end of transition joint assembly 22 may attach directly to upper caisson heavy wall portion 66, or an intermediate section or portion may be positioned between transition joint assembly 22 and upper caisson heavy wall portion 66. In the exemplary embodiment of FIG. 2, conical portion 26 of transition joint assembly 22 is connected directly to upper caisson heavy wall portion 66.

Transition joint assembly 22 may be formed of sections or portions for convenience of manufacturing. For example, cylindrical portion 24 of transition joint assembly 22 may include a transition joint heavy wall portion 76 that may form an attachment location for upper angled braces 40. In the exemplary embodiment of FIGS. 2 and 3, conical portion 26 is formed separately from cylindrical portion 24 and attached directly to cylindrical portion 24. In an exemplary embodiment, such attachment is by welding, such as butt welding, fillet welding, or a combination of welding types. In the exemplary embodiment, cylindrical portion 24 includes a transition flange 78, which may have a slight bell or angle to accept or mate with a base of support tower 16, which may be described as a tower base flange or a tower base, of an offshore device such as wind turbine assembly 12. In another embodiment, the transition flange may be configured to receive an external coupler that connects an offshore device to transition joint assembly 22. Once in place, the offshore device is either directly welded or otherwise attached, e.g., bolted, to transition joint assembly 22, or a coupler may be welded to transition joint assembly 22 and to the offshore device, depending on the configuration of the offshore device. In another exemplary embodiment (not shown), a bearing assembly may be positioned internal to transition joint assembly 22 to permit the offshore device to rotate with respect to transition joint assembly 22, which may be advantageous for certain types of offshore devices, such as wind turbines and solar panel arrays.

Support structure 10 is subject to thrust, bending, and torsional stresses transmitted into support structure 10 either by wave action or by wind. These stresses can lead to fatigue at joints between one or more of upper angled braces 40, upper middle angled braces 42, lower middle angled braces 44, and lower diagonal braces 46; and caisson sleeve 18, pile sleeves 20, and transition joint assembly 22. Because transition joint assembly 22 is hollow and has a relatively large internal diameter, the effect of such stresses on the interface or joint between upper angled brace 40 and cylindrical portion 24 of transition joint assembly 22 can be more significant than effect of stresses on the interface between various braces and either caisson sleeve 18 or pile sleeves 20. While conventional cylindrical braces and a concrete reinforced transition joint assembly provide significant life, under some combinations of load from an offshore device, load from wave action, and torsion induced by wave action or wind action, increased fatigue strength may be needed to provide adequate life for support structure 10.

Referring to FIGS. 3-7, features of transition joint assembly 22 and upper angled brace 40 are shown in more detail. The configuration of transition joint assembly 22 and upper angled brace 40 provide support structure 10, and particularly the joint or interface between transition joint assembly 22 and upper angled brace 40, improved strength and durability, providing a longer life and greater reliability to transition joint assembly 22, upper angled brace 40, and support structure 10 in comparison to conventional designs.

Figure 3:
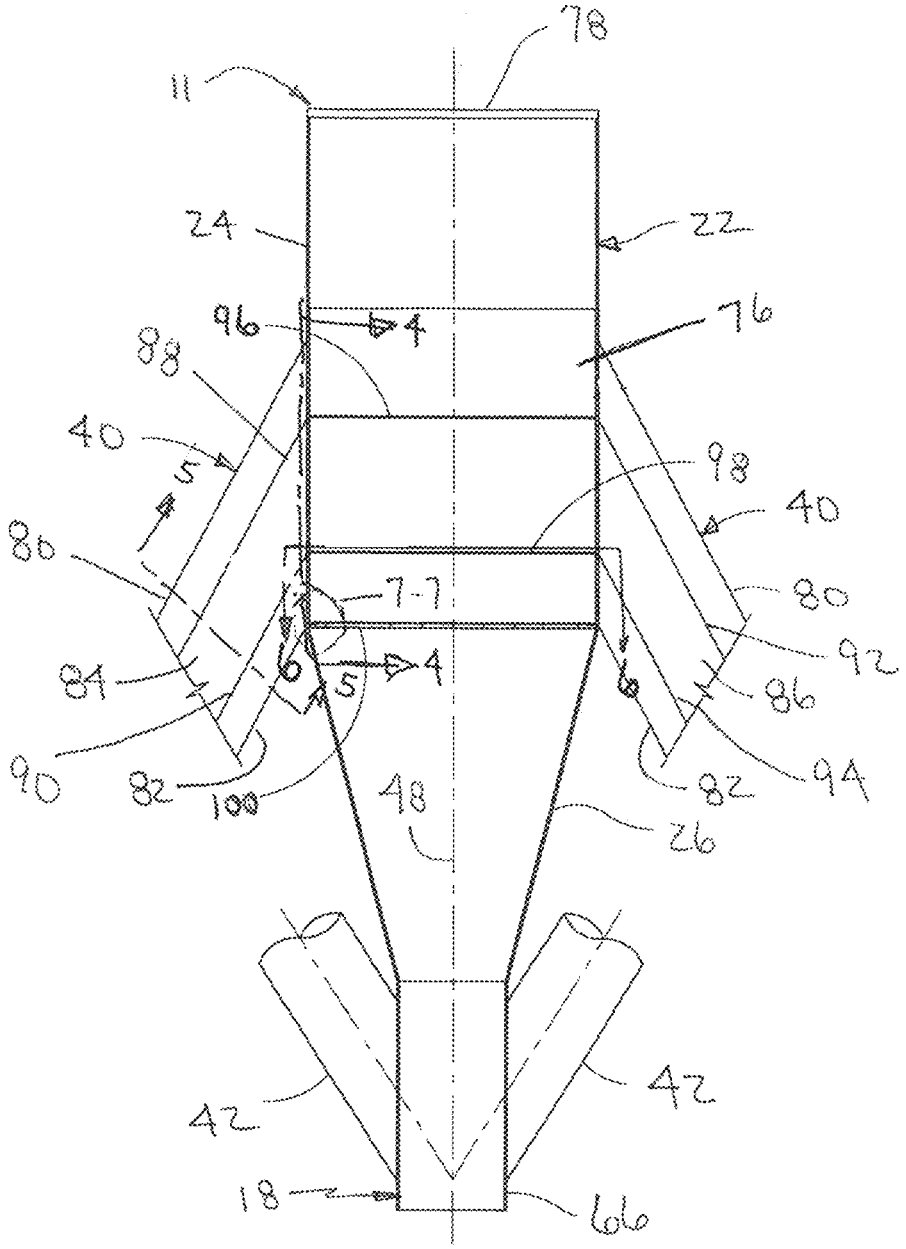
FIG. 3 is a view of a portion of the sub-support or guide portion of FIG. 2, including a transition joint and portions of various braces.
Figure 4:
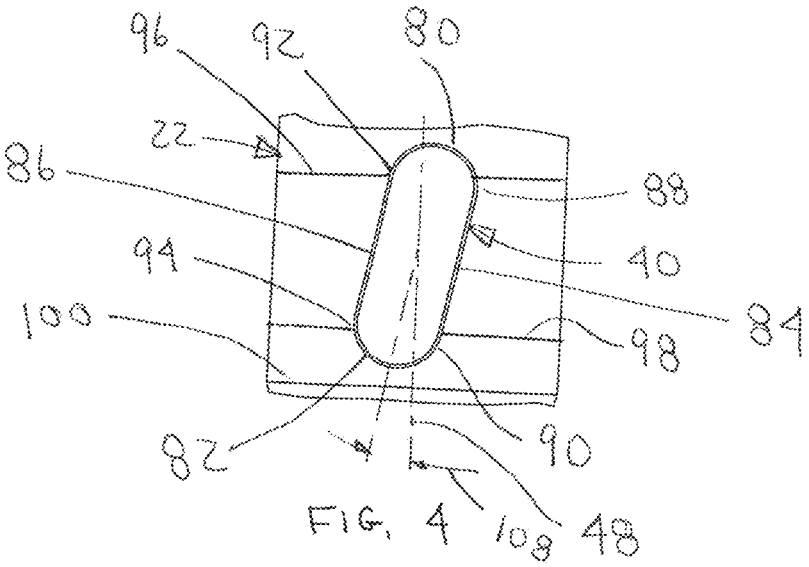
FIG. 4 is a sectional view of an upper brace along the lines 4-4 in FIG. 3 where the upper brace attaches to the transition joint.
Figure 5:
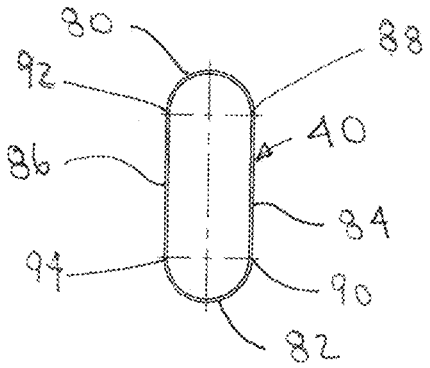
FIG. 5 is a sectional view of the upper brace of FIG. 4 along the lines 5-5 in FIG. 3.

In the exemplary embodiment shown in, for example, FIGS. 3-5, each upper angled brace 40 is shaped in a configuration that can be described as an oval, racetrack, obround, or stadium. In cross section, as shown, for example, in FIG. 5, each upper angled brace 40 includes an upper curvilinear portion 80 that in an exemplary embodiment may be a half round, and a lower curvilinear portion 82 that in an exemplary embodiment may also be a half round. Each upper angled brace 40 further includes a first brace side 84 positioned between upper curvilinear portion 80 and lower curvilinear portion 82 and a second brace side 86 positioned between upper curvilinear portion 80 and lower curvilinear portion 82 on opposite sides of upper angled brace 40. Upper angled brace 40 may be formed in a variety of ways, including extrusion, casting, or welding.

Though upper angled brace 40 may be a single piece when considering a cross section, such as that shown in FIG. 5, the location where first brace side 84 transitions to upper curvilinear portion 80 and to lower curvilinear portion 82 may be considered a first seam 88 and a second seam 90, though such "seams" may not actually exist when upper angled brace 40 is formed by, for example, an extrusion process. Similarly, second brace side 86 includes a third seam 92 and a fourth seam 94.

Figure 6:
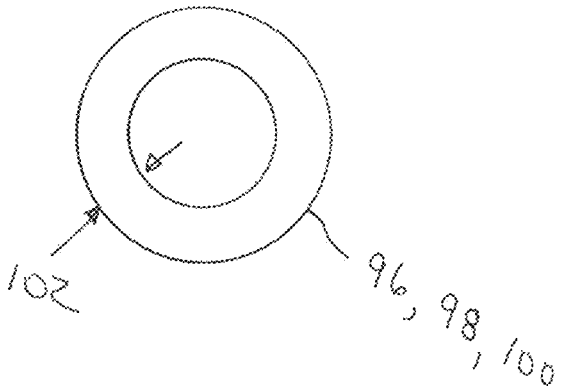
FIG. 6 is a view of a ring stiffener of the transition joint of FIG. 3 along the lines 6-6.

Referring to FIGS. 3, 4, and 6, transition joint assembly 22 further includes a plurality of horizontal or transverse stiffeners, including, in the exemplary embodiment, an upper transition stiffener 96, an intermediate or middle transition stiffener 98, and a lower transition stiffener 100, which may be described as a ring-stiffened chord configuration. In the exemplary embodiment, each stiffener 96, 98, and 100 may appear as shown in FIG. 6, being generally in the shape of an annulus or a doughnut. Because of the way in which stress is communicated into cylindrical portion 24 by each upper angled brace 40, stiffeners 96, 98, and 100 need not be solid disks, though in an exemplary embodiment, stiffeners 96, 98, and 100 may be solid disks. Furthermore, sufficient resistance to the flexing of the wall of cylindrical portion 24 may be obtained by, in an exemplary embodiment, a width 102 of each stiffener that is in the range of 10% to 20% of the diameter of cylindrical portion 24. However, the desirable range depends on the diameter of cylindrical portion 24, the thickness of the wall of cylindrical portion 24, the material of cylindrical portion 24, and the anticipated stresses to which support structure 10 may be subjected, which depends greatly on the operating environment.

In the exemplary embodiment shown in FIGS. 3 and 4, each upper angled brace 40 is positioned such that at least two of first seam 88, second seam 90, third seam 92, and fourth seam 94 are approximately at the same vertical position (a direction that is along longitudinal axis 48) as upper transition stiffener 96 and intermediate or middle transition stiffener 98. Applicant unexpectedly discovered that when at least two of first seam 88, second seam 90, third seam 92, and fourth seam 94 are positioned to approximately intersect upper transition stiffener 96 and/or intermediate or middle transition stiffener 98, decreased flexing of the wall of cylindrical portion 24 was obtained, which decreased the stress on the joint between upper angled braces 40 and transition joint assembly 22, and thus increased the life and reliability of support structure 10. Furthermore, the decreased flexing improved the fatigue life of support structure 10 with minimal change in the cost of support structure 10, which thus provides substantial benefit to support structure 10.

It should be noted that each upper angled brace 40 extends at an angle that is approximately the same as the angle of an associated pile sleeve 20 with respect to vertical longitudinal axis 48, as shown in, for example, FIG. 2. Upper angled brace 40 must extend at this angle because the oval or elongated shape of upper angled brace 40 mates best with an associated pile sleeve 20 when the longer cross-sectional dimension of upper angled brace 40 extends in the same direction as an axis extending along or longitudinally through an associated pile sleeve 20. Because each upper angled brace 40 is positioned to match an angle of an associated pile sleeve 20, each upper angled brace 40 forms an angle 108 with respect to vertical longitudinal axis 48. Because it is preferable to match the angle of each upper angled brace 40 to the angle of an associated pile sleeve 20, and because the angle of pile sleeves 20 determines the width of the base or widest portion of support structure 10, angle 108 needs to be limited to make the base width practical. Thus, in an exemplary embodiment, angle 108 may be in the range extending from about 4.5 degrees to about 22 degrees.

Figure 7:
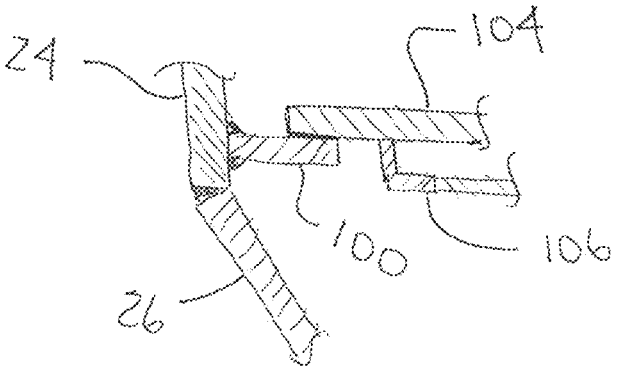
FIG. 7 is a sectional view of a portion of the transition joint of FIG. 3 along the lines 7-7.

Transition joint assembly 22 may include other features. Referring to FIG. 7, transition joint assembly 22 may include an airtight platform 104 positioned on lower transition stiffener 100. Airtight platform 104 may include a plurality of stiffening ribs 106. Airtight platform 104 prevents water, sand, mud, and other undesirable contaminants from passing from conical portion 26 of transition joint assembly 22 to cylindrical portion 24, which could undesirably compromise the integrity of the interface between the offshore device and transition joint assembly 22.

Figure 8:
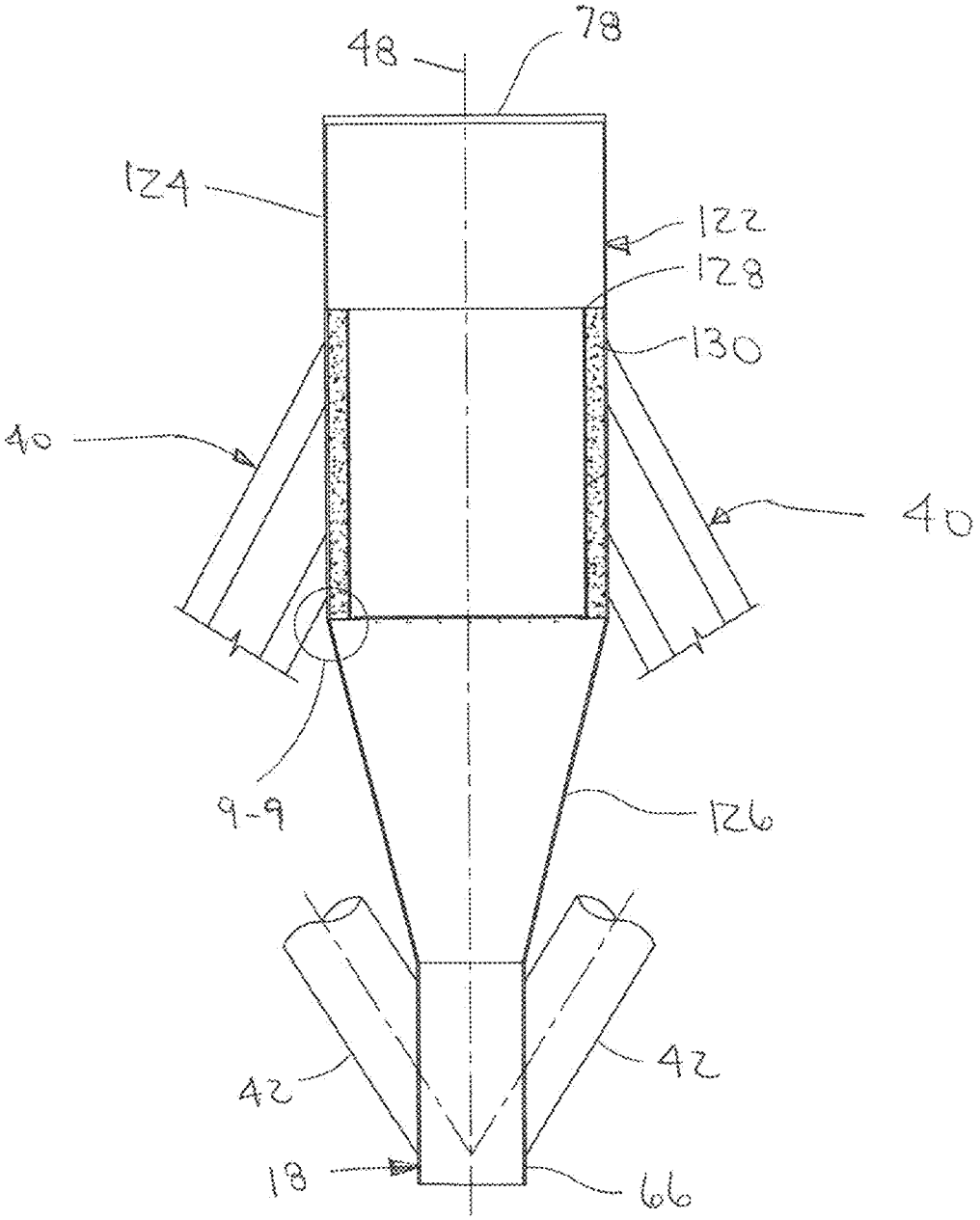
FIG. 8 is a partial sectional view of a transition joint in accordance with an alternative exemplary embodiment of the present disclosure.
Figure 9:
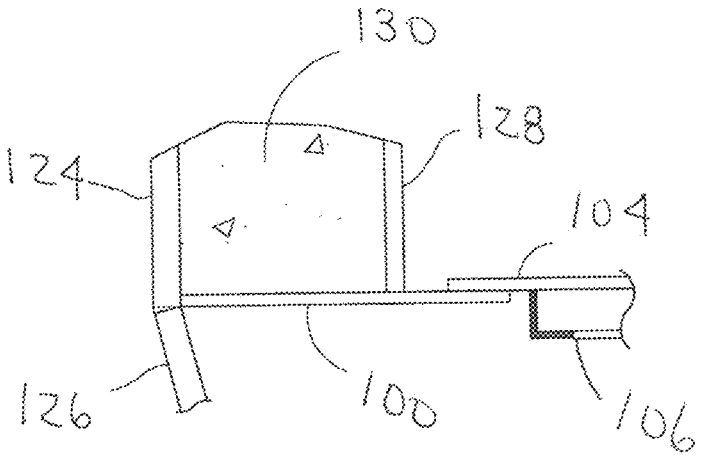
FIG. 9 is a sectional view of the transition joint of FIG. 8 along the lines 9-9, showing a lower internal platform of the transition joint.

FIGS. 8 and 9 depict an alternative embodiment transition joint assembly 122. Transition joint assembly 122 includes a cylindrical portion 124 and a conical portion 126. Cylindrical portion 124 of transition joint 122 includes a "shell" formed of the wall of cylindrical portion 124 and a liner 128, with a grout, cement, or similar hardening material 130 positioned between liner 128 and cylindrical portion 124 to add rigidity or stiffness to cylindrical portion 124; i.e., a grout-stiffened chord configuration. Liner 128 may be a suitable metal, or may be another material, such as fiberglass or plastic. Transition joint 122 also includes, as shown in FIG. 9, stiffener 100 and airtight platform 104. Because of the rigidity of grout 130 in combination with liner 128 and cylindrical portion 124, transition joint assembly 122 provides strength and resistance to fatigue damage required for offshore device support and operation while minimizing construction costs. Transition joint 122 transfers the forces and moments, generated by gravity and the aerodynamic response of the wind turbine and the wind turbine supporting tower, from the tower base flange to support structure members (e.g., pile sections 34) for dissipation into the surrounding soils. The concreted shell design increases the effective thickness of the joint without use of additional heavy wall steel material. Steel reinforcement such as rebar is preferably used with concrete and grout. In other embodiments, a stud arrangement on the inner surface of the outer shell may be used to ensure adequate positioning of the strengthening material on the outer shell.

While various embodiments of the disclosure have been shown and described, it is understood that these embodiments are not limited thereto. The embodiments may be changed, modified, and further applied by those skilled in the art. Therefore, these embodiments are not limited to the detail shown and described previously, but also include all such changes and modifications.

I claim:

1. An offshore device comprising:

a support structure including:

a caisson sleeve extending in a vertical direction;

a transition assembly positioned on a proximate end of the caisson sleeve, the transition assembly including a cylindrical portion and a conical portion, the conical portion being positioned between the cylindrical portion and the caisson sleeve;

a plurality of pile sleeves, each pile sleeve of the plurality of pile sleeves being positioned at an angle with respect to the vertical direction and spaced a radial distance from the caisson sleeve;

a plurality of upper angled braces extending from the plurality of pile sleeves upwardly and inwardly to the cylindrical portion of the transition assembly, each upper angled brace having a first end connected to the pile sleeves at a position at least partially horizontally aligned with the conical portion of the transition assembly and a second end connected to the cylindrical portion at a first longitudinal position, each upper angled brace having at least one of a racetrack, oval, obround, or stadium shape when viewed in cross-section; and a plurality of other braces extending from each pile sleeve of the plurality of pile sleeves to the caisson sleeve, the plurality of other braces including a plurality of upper intermediate braces extending from the plurality of pile sleeves downwardly and inwardly to the caisson sleeve, each upper intermediate brace having a first end connected to the pile sleeves at a position horizontally aligned with the conical portion of the transition assembly and a second end connected to the caisson sleeve at a second longitudinal position; and an assembly positioned on an opposite side of the transition assembly from the caisson sleeve.

2. The offshore device of claim 1, wherein the cylindrical portion includes at least one horizontal stiffener.

3. The offshore device of claim 2, wherein each upper angled brace includes at least one seam.

4. The offshore device of claim 1, wherein each brace is extended at a non-perpendicular angle with respect to the vertical direction.

5. The offshore device of claim 1, wherein each brace, as measured from the vertical direction, has an angle approximately in the range of 4.5 to 22 degrees.

6. The offshore device of claim 1, wherein the plurality of pile sleeves is three pile sleeves, and the three pile sleeves are positioned approximately 120 degrees apart from each other in a circumferential direction.

7. The offshore device of claim 1, wherein the cylindrical portion includes a grout-stiffened chord.

8. The offshore device of claim 1, wherein a diameter of the cylindrical portion is at least twice a diameter of the caisson sleeve.

9. The offshore device of claim 1, wherein a diameter of the cylindrical portion is at least two and half times a diameter of the caisson sleeve.

10. The offshore device of claim 1, wherein the assembly is a wind turbine.

* * * * *